US007234507B2

(12) United States Patent
Jahedi et al.

(10) Patent No.: US 7,234,507 B2
(45) Date of Patent: Jun. 26, 2007

(54) DIE COATINGS FOR GRAVITY AND LOW PRESSURE DIE CASTING

(75) Inventors: Mahnaz Jahedi, Preston (AU); Mary Giannos, Preston (AU); Stefan Gulizia, Werribee (AU)

(73) Assignee: Cast Centre Pty Ltd., Department of Mining, Minerals and Materials, Engineering, University of Queensland, Saint Lucia, Queensland (AU)

( * ) Notice: Subject to any disclaimer, the term of this patent is extended or adjusted under 35 U.S.C. 154(b) by 0 days.

(21) Appl. No.: 10/749,511

(22) Filed: Jan. 2, 2004

(65) Prior Publication Data

US 2004/0244936 A1 Dec. 9, 2004

Related U.S. Application Data

(63) Continuation of application No. 09/937,038, filed as application No. PCT/AU00/00239 on Mar. 23, 2000, now abandoned.

(30) Foreign Application Priority Data

Mar. 23, 1999 (AU) ..... PP9390

(51) Int. Cl.
*B22C 9/06* (2006.01)

(52) U.S. Cl. ..... 164/138; 164/72

(58) Field of Classification Search ..... 164/138, 164/267, 72

See application file for complete search history.

(56) References Cited

U.S. PATENT DOCUMENTS

| | | | | |
|---|---|---|---|---|
| 4,269,903 | A * | 5/1981 | Clingman et al. | 428/591 |
| 5,194,339 | A | 3/1993 | Sugitani et al. | |
| 5,250,242 | A * | 10/1993 | Nishio et al. | 264/625 |
| 5,530,050 | A * | 6/1996 | Rangaswamy | 524/430 |

* cited by examiner

*Primary Examiner*—Len Tran
(74) *Attorney, Agent, or Firm*—Dennison, Schultz & Macdonald

(57) ABSTRACT

A die coating for use on the surface of a metal mold or die component contacted by molten metal in low pressure or gravity die casting, and a method for its production. The die coating includes a porous layer of ceramic material produced by co-deposition, using a thermal spraying procedure, of a powder of said ceramic material and a powder of an organic polymer material. After the co-deposition, the co-deposited layer is heated to remove the polymer material, and provide the porous layer of ceramic material.

52 Claims, No Drawings

DIE COATINGS FOR GRAVITY AND LOW PRESSURE DIE CASTING

This application is a continuation of Ser. No. 09/937,038 filed May 10, 2002, now abandoned, which is a filing under 35 USC 371 of PCT/AU00/00239, Mar. 23, 2000.

FIELD OF THE INVENTION

This invention relates to die coatings, to a process for providing permanent mould or die components with an improved die coating, and to a die coating material for use in such process.

BACKGROUND OF THE INVENTION

In low pressure and gravity die casting, the surface of each metal mould or die component, which is contacted by molten metal, is provided with a mould or die coating. Under current procedures, a ceramic-based coating is used at a thickness of from about 0.05 to 1.0 mm. The main function of the coating is to provide a degree of insulation which is intended to prevent premature solidification of the molten metal, and thereby enable the complete filling of the die cavity before solidification starts. However, the coating also is to protect the steel die surfaces from erosion or corrosion by impingement by or contact with molten metal.

Current die coating technology involves the use of a water-based suspension of ceramic particles containing a water-based binder, most commonly sodium silicate. Coating mixtures of this type need to be properly stored, while stirring and testing to prepare them for use often involves tedious procedures. The coating is applied to the sand or shot blasted surface of a die component using a pressurized air spray gun. For this, the component is preheated, typically from about 150 to 220° C., such that water is evaporated from the die surface, enabling the binder to polymerize and bond the ceramic particles together and to the die surface.

The die coatings produced with the current aqueous ceramic suspensions are highly porous. The level of porosity may range from about 30 to 60%, depending on the size and shape of the ceramic particles and the amount of binder used. High porosity gives the coating very good insulating properties. However, the strength of the coatings is limited by the strength of the binder used (about 6.9 MPa in the case of sodium silicate) and the level of porosity of the coating.

Important factors in a thermally insulating die coating are porosity and surface roughness. Also, wear resistance is important since a coating with an inadequate level of wear resistance is prone to damage in use, with a consequential reduction in its useful life-time. The sodium silicate bonded coatings, produced with the current aqueous ceramic suspensions, have a low level of wear resistance which results in them having a productive life-time of not more than about two to four 8-hour shifts. However, even during such a short life-time, production needs to be stopped from time to time to enable repair of the coating by a "touch-up" operation.

In U.S. Pat. No. 4,269,903 to Clingman et al, there is disclosed a ceramic seal coating formed on at least one of two relatively rotatable members, such as rotating air foils of an axial flow compressor. The process seeks to provide a seal coating as disclosed in U.S. Pat. No. 4,055,705 to Stecura et al, which has improved abradability. The coating of U.S. Pat. No. 4,055,705 comprises a bond coat of NiCrAlY alloy applied to a substrate and a thermal barrier which is applied over the bond layer and comprises zirconia stabilized with another oxide. The advance provided by U.S. Pat. No. 4,269,903 is in providing over that thermal barrier layer an abradable layer of porous stabilized zirconia. The porous layer is formed by thermal decomposition of organic filler material, which is co-deposited with stabilized zirconia onto the barrier layer. The co-deposition, such as by plasma spray or thermal spray process, preferably uses separate streams of organic and zirconia powders, with the organic powder chosen from a range of suitable thermoplastics. After co-deposition, the organic material is decomposed by heating, to leave an abradable zirconia layer having a porosity of from about 20 to about 33% and, hence, a suitable level of abradability. The abradable layer enables wear of at least one of two relatively rotatable components in rubbing contact such that loss of a fluid seal between the components is avoided.

In the process of U.S. Pat. No. 4,269,903 the organic material is used because, after its co-deposition with zirconia, the organic material is able to be removed by thermal decomposition to leave a porous, and hence abradable, layer of zirconia. An alternative purpose for co-deposition of organic powders with ceramic and/or metal powders is disclosed in U.S. Pat. No. 5,718,970 to Longo.

The process of U.S. Pat. No. 5,718,970 is concerned with providing a substrate with a thermally sprayed duplex coating of a plastics material which is co-deposited with a higher melting point ceramic material and/or metal. It is asserted that while metal and ceramic powders necessitate spraying with high temperature gas streams, such as plasma sprays or acetylene gas, plastic powders are usually sprayed with low temperature gas streams, such as hydrogen or natural gas, to prevent superheating and oxidation of the plastic powder. The solution for achieving a duplex coating is to use a powder comprising particles having a core of plastic material and, on the core, a substantially continuous particulate cladding of ceramic and/or metal. The cladding may be adhered to the core as a consequence of heating to soften the core, or by use of a suitable binder. The duplex coating produced by thermal spraying of such powders is able to exhibit characteristics of the ceramic and/or metal and of the polymer material, with the coating indicated as having particles of the plastic material dispersed in a continuous matrix of the ceramic and/or metal.

SUMMARY OF THE INVENTION

The present invention seeks to provide an improved die coating, a process for providing a permanent mould or die component with a an improved die coating and a die coating material for use in the process of the invention.

An improved die coating according to the present invention, for use on the surface of a mould or die component contacted by molten metal in low pressure or gravity die casting, includes a porous layer of ceramic material produced by co-deposition, using a thermal spraying procedure, of a powder of the material and a powder of a suitable organic polymer material and, after the co-deposition, heating of the polymer material to cause its removal.

The invention also provides a process for providing a die coating on such surface of a metal mould or die component, wherein an initial coating of organic polymer material and ceramic material is formed on the surface by co-deposition of powders of the materials by a thermal spraying procedure, and the initial coating is heated so as to remove the polymer material and leave a porous coating of the ceramic material.

The polymer material may be heated so as to remove the polymer material by combustion and/or by decomposition, with decomposition generally being preferred.

The thermal spraying procedure used in the present invention may be of any suitable type. Thus the co-deposition may be by flame spraying, plasma spraying or electric arc spraying.

DETAILED DESCRIPTION OF THE INVENTION

The die coating of the present invention and the process for its production have some features which seemingly are similar to features of the disclosure of U.S. Pat. No. 4,269,903 in relation to a porous abradable layer. However, as indicated above, the disclosure of U.S. Pat. No. 4,269,903 is concerned with an abradable ceramic seal coating on at least one of a pair of members, which move relative to each other in rubbing contact. That is, the disclosure is quite unrelated to the context of a die coating for surfaces of metal mould or die components contacted by molten metal. Moreover, the disclosure of U.S. Pat. No. 4,269,903 is limited to a porous layer of stabilized zirconia, which is abradable. In contrast, the die coating of the invention in addition to not being limited to the use of zirconia, has an enhanced level of wear resistance which enables a substantially increased useful life-time relative to current die coating technology discussed above. There is little basis for correlating abradable in the context of U.S. Pat. No. 4,269,903 with wear resistance in the context of a die coating. However, particularly as a die coating is required to have a high level of abrasion resistance in order to be able to withstand the impingement and flow of molten metal at the high temperature levels, prevailing in low pressure and gravity die casting, the benefits resulting from the die coating of the invention are surprising in view of the disclosure of U.S. Pat. No. 4,269,903 which teaches an abradable, rather than an abrasion resistant, coating.

The ceramic powders which are used in providing the die coating of the present invention may be a processed powder conventionally used in the production of ceramic articles. Thus, the powder may be selected from at least one metal compound such as oxides, nitrides, carbides and borides. Suitable examples include alumina, titania, silica, stabilized zirconia, silicon nitride, boron nitride, silicon carbide, tungsten carbide, titanium borides and zirconium boride. However, the ceramic powder may be of a suitable mineral origin such as clay minerals, hard rock ore and heavy mineral sands such as those of ilmenite, rutile and/or zircon. One particularly suitable powder is that obtained from scoria or pumice, since powder particles of these materials are internally porous and have the added benefit of being of angular form.

A wide range of plastics and like materials can be used to provide the organic polymer powder. Important requirements for selection of these are availability in a suitable powder form and an ability to withstand sufficiently the temperatures to which they are exposed during thermal deposition. A further requirement is an ability to be combusted or decomposed at practical temperatures and in practical reaction times. In large part, the materials comprise thermoplastics, such as polystyrene, styrene-acrylonitrile, polymethacrylates, polyesters, polyamides, polyamide-imides and PTFE.

The respective powders, that is the ceramic powder and the polymer powder, preferably are of a relatively narrow size spectrum. In general, they preferably are of particle sizes not more than about 60 μm and not less than about 1 μm in the case of the ceramic and not less than about 5 μm in the case of the polymer material.

The process of the invention can be used in a variety of forms. In one form, a substantially uniform die coat is provided over all surfaces of mould or die components, which define a die cavity. The coating may, for example, have a thickness of from about 250 to 400 μm, such as from about 300 to about 400 μm. In that form, the coating provides insulation over all surfaces of the die cavity, enabling filling of the cavity before molten metal being cast commences solidification.

The die coating provided by the invention, because of its porosity, acts as a thermal barrier. In contrast, a non-porous coating of the same material will be less effective as a thermal barrier. This enables alternative useful forms of the invention in which use is made of a die coating according to the invention in combination with a non-porous coating. In one alternative, one surface or part of the overall surface defining a die cavity is provided with a non-porous ceramic die coating which is less insulating, while other surfaces or parts of the surface are provided with a thermal barrier die coating according to the invention. This arrangement enables heat energy extraction, from molten metal in the die cavity, to be at a higher rate through the non-porous coating than through the porous thermal barrier die coating. Thus, directional solidification is able to be facilitated, to achieve solidification of the molten metal in a direction away from the non-porous coating.

In a further alternative, all surfaces defining a die cavity, or one or a part of such a surface, can be provided with successive die coatings which alternately are porous and non-porous. That is, the full thickness of at least part of the die coating may consist of at least two layers of a sandwich or lamella form. As a consequence, the die coating will have a thermal conductivity intermediate that of corresponding coating thickness of non-porous and porous die coatings, respectively, of the same ceramic material. Thus, the range of differential control over heat energy extraction from molten metal being cast can be enhanced.

In each of those alternatives of the invention, the porous and non-porous regions or layers of the die coating may be of the same ceramic material or of a respective ceramic material.

In order that the invention may more readily be understood, the description now is directed to the following Examples.

EXAMPLE 1

Ceramic powder and polymer powder were mixed and subjected to flame spraying to form a co-deposited coating on a die cavity defining the surface of a low pressure metal die cast component. The ceramic powder was Metco 210 grade zirconia stabilized by 24% magnesium oxide for which the data sheet indicated a particle size range of (−53) to (+10) μm, a melting point 2140° C. and a density of 4.2 $gcm^{-3}$. The polymer powder was of polystyrene supplied by Huntsman Chemical Company Australia Pty. Ltd., which had been ground to −45 μm under liquid nitrogen, using a SPEX Freezer mill. The powder mixture of MgO(24%) $ZrO_2$/polystyrene contained 15 volume percent (4 wt %) of polystyrene.

The co-deposition of the powder mixture was performed using a Metco Type 6P-II Thermospray system, with a P7C-K nozzle and a 3 MPa powder feeder, under the following conditions:

| | |
|---|---|
| Pressure: | oxygen $2.07 \times 10^{-1}$ MPa; acetylene $1.035 \times 10^{-1}$ MPa; |
| Flow: | oxygen 20 l/min; acetylene 24 l/min $m^3S^{-1}$ |
| Carrier Gas: | $N_2$ at $3.78 \times 10^{-1}$ MPa and 18 l/min |
| Powder Feeder: | 15 (rpm) |
| Spray Distance: | 76 mm |

Also, the system used an air jet, which operated at a pressure of $3.45\times10^{-1}$ MPa and crossed at 63.5 mm from the nozzle.

Following co-deposition of the blended powders, the deposited coating was heated to 450° C. for one hour to cause the polystyrene to decompose. Polystyrene decomposes fully at 320 to 350° C. in nitrogen (DTA/TGA). The porous, stabilized zirconia coating resulting from removal of the polystyrene by decomposition was found to comprise an excellent die coating in having good abrasion resistance enabling it to withstand the impingement of molten metal during low pressure and gravity die casting. The die coating also exhibited a low heat transfer coefficient, such that solidification of molten metal during such casting was able to be delayed until filling of the die cavity was complete.

EXAMPLE 2

The overall procedure of Example 1 was repeated, with scoria powder used instead of stabilized zirconia. The scoria powder was produced by drying scoria rocks in an oven at 100° C., crushing the dried rocks using a ring mill, and sieving the crushed rock using a shaker and several screens of decreasing size to separate the powder. The scoria powder used had a size range of 45 to 75 μm and a density of 2.9 $gcm^{-3}$. It was blended with polystyrene powder, as produced and characterized in Example 1, to achieve a blend having 15 volume percent of polystyrene.

The conditions of flame spraying and decomposition of the co-deposited polystyrene were as detailed in Example 1. The resultant porous, scoria die coating was of similar characteristics to the zirconia coating produced in Example 1, but was more effective as a thermal barrier coating due to it having a lower heat transfer co-efficient than zirconia.

EXAMPLE 3

Three powder blends with 15 vol % polystyrene were produced in the manner detailed in Example 1. Each of these differed from Example 1 in that the size range of the polystyrene powder blended with the MgO (24%) stabilized $ZrO_2$ was 45 to 75 μm, 75 to 106 μm and 106 to 150 μm, respectively.

In contrast to Example 1, each of the three powder blends was co-deposited by plasma-spraying, using a spray gun designated as a SG100 subsonic having a power rating of 40 kw, an anode setting of 185 volts, a cathode setting of 129 volts and a gas injector, Miller 113. Operating parameters used were:

| | |
|---|---|
| Power: | open circuit 160 V, operating power at 33 V and 800 A |
| Arc/Primary gas: | argon, critical orifice No. 56 (flow rate 47 l/min); pressure reg. $3.45 \times 10^{-1}$ MPa |
| Auxiliary/Secondary gas: | helium, critical orifice No. 80 (flow rate 12 l/min), pressure reg. $3.45 \times 10^{-1}$ MPa |
| Powder gas/carrier: | argon, critical orifice No. 77 (6 l/min), pressure reg. $2.76 \times 10^{-1}$ MPa, hopper 2.8 rpm |
| Spray distance: | 96 mm |

Following co-deposition of each of the three powder blends, the deposited coating was heated as detailed in Example 1. The porous, stabilised zirconia coatings resulting from the removal of polystyrene by decomposition were of similar characteristics to the coating produced in Example 1.

EXAMPLE 4

The overall procedure of Example 3 was repeated, using a blend of scoria powder produced as in Example 2 and 45 μm polystyrene powder produced as in Example 1. The condition of plasma spraying of the scoria/15 vol % polystyrene powder blend, and decomposition of co-deposited polystyrene, was the same as in Example 3. The resultant porous scoria die coating was of similar characteristics to that produced in. Example 2.

The process of die coating using the current technology is considered as an art in which the control of coating quality and thickness are highly operator dependent. The bond between ceramic particles provided by polymerized sodium silicate is not very strong. Therefore, sodium silicate bonded coatings are fragile and not wear resistant.

On the other hand, in the new die coating system of the present invention, there is no separate binder. The ceramic particles are partially melted and then bonded together which provides stronger bonding system. Changing the percentage of the porosity of the coating can alter the heat transfer coefficient properties of the die coating of the present invention. This can be easily achieved by changing the percentage of the polymer used in producing the die coating. This gives the advantage to tailor directional solidification for the die casting part to minimize the occurrence of shrinkage related defects.

Use of the present invention is very flexible. Changing the polymer size can change the surface roughness of the coating. For the purpose of good adhesion a first layer of the coating can be applied without addition of polymer. A second layer can contain polymer particles to provide porosity to improve insulating properties of the coating. A final layer can be also without polymer if very smooth surface is required.

Low pressure and gravity die casting processes require that the molten metal flow readily in the complicated die cavity in order to create the die casting. Low pressure die casting in particular involves the movement of molten metal against gravity in order to fill the die cavity completely. Often the molten metal is transported through narrow sections and the insulation provided by the die coating is found to be critical in these areas. The surface roughness of the coating affects the ability of the molten metal to flow into the die cavity by creating minute pockets of air between the peaks of the coating and where it contacts the molten metal. The molten metal does not completely wet the total surface area of the coating, and these pockets of air are an important factor influencing fluidity and therefore the filling of the die cavity in order to produce sound castings.

The addition of evaporable components, specifically polymer powders creates a high degree of porosity as well as affecting the surface profile of the resultant coating. This surface roughness can be changed by changing the size of the polymer particles added to the ceramic powder mix for plasma sprayed coatings. The flexibility of changing the surface roughness also has applications in influencing the surface finish of the final casting.

The variation in surface roughness with polymer particle size can be illustrated with reference to Example 3. A die coating produced with the MgO(24%) stabilized $ZrO_2$ of that Example, without added polymer, was found to have a surface roughness of $R_a$ of 4.5 μm. The die coating produced using the zirconia and 15 vol % of 45 to 75 μm polystyrene had a surface roughness $R_a$ of 10 μm, while that produced with 15 vol % of 75 to 106 μm polystyrene had a surface roughness of 25 μm.

Finally, it is to be understood that various alterations, modifications and/or additions may be introduced into the constructions and arrangements of parts previously described without departing from the spirit or ambit of the invention.

The invention claimed is:

1. A die coating for use on the surface of a metal mold or metal die component contacted by molten metal in low pressure or gravity die casting, said die coating including a porous thermal barrier layer of ceramic material produced by co-deposition, using a thermal spraying procedure, of a powder of said ceramic material and a powder of an organic polymer material and, after the co-deposition, heating said co-deposited layer on the mold or die component to remove the polymer material, and provide said porous layer of ceramic material, said porous thermal barrier layer of ceramic material having a thickness of about 250 to 400 μm.

2. A die coating according to claim 1, wherein said ceramic powder is at least one ceramic powder selected from the group consisting of oxides, nitrides, carbides and borides.

3. A die coating according to claim 1, wherein said ceramic powder is at least one mineral compound powder selected from the group consisting of clay minerals, hard rock ore and heavy mineral sands.

4. A die coating according to claim 3, wherein said ceramic powder is obtained from scoria or pumice.

5. A die coating according to claim 1, wherein said organic polymer powder is formed from a thermoplastic material.

6. A die coating according to claim 1, wherein each of said ceramic and polymer powders is of relatively narrow size spectrum.

7. A die coating according to claim 6, wherein said ceramic and polymer particles are of particle sizes not more than about 60 μm and not less than about 1 μm in the case of said ceramic powder and not less than about 5 μm and not more than 45 μm in the case of the polymer powder.

8. A process for providing a die coating on the surface of a metal mold or metal die component, comprising the steps of forming an initial coating of organic polymer material and ceramic material on the surface by co-deposition of powders of the materials by a thermal spraying procedure, and heating the initial coating to a temperature of less than 450° C. so as to remove the polymer material and leave a coating of ceramic material with voids therein, thus forming a porous thermal barrier coating of the ceramic material.

9. A process according to claim 8, wherein said polymer material is removed by combustion and/or decomposition.

10. A process according to claim 8, wherein said thermal spraying procedure is either flame spraying, plasma spraying or electric arc spraying.

11. A process according to claim 8, wherein a substantially uniform die coat is provided over all surfaces of the mold or die components, which define a die cavity.

12. A process according to claim 11, wherein said coating has a thickness of from about 250 to 400 μm.

13. A process according to claim 12, wherein said coating has a thickness of from about 300 to about 400 μm.

14. A metal mold or die component having a surface for contact by molten metal in low pressure or gravity die casting, said surface being coated fully, or in a section or sections thereof, by a die coating according to claim 1.

15. A die coating according to claim 5, wherein said thermoplastic material is selected from the group consisting of polystyrene, styrene-acrylonitrile, polymethacrylates, polyesters, polyamides, polyamide-imides and PTFE.

16. A die coating according to claim 2, wherein said ceramic powder is at least one ceramic powder selected from the group consisting of alumina, titania, silica, stabilized zirconia, silicon nitride, boron nitride, silicon carbide, tungsten carbide, titanium borides and zirconium boride.

17. A die coating according to claim 3, wherein said ceramic powder is at least one mineral compound powder selected from the group consisting of ilmenite, rutile and zircon.

18. A metal mold or metal die component having a surface for contact by molten metal in low pressure or gravity die casting, said surface being coated in a section or sections thereof with a non-porous ceramic die coating and in another section or sections thereof, with a die coating including a porous thermal barrier layer of ceramic material produced by co-deposition, using a thermal spraying procedure, of a powder of said ceramic material and a powder of an organic polymer material and, after the co-deposition, heating said co-deposited layer on the mold or die component to remove the polymer material, and provide said porous thermal barrier layer of ceramic material having a thickness of about 250 to 400 μm.

19. A metal mold or metal die component having a surface for contact by molten metal in low pressure or gravity die casting, said surface being coated fully, or in a section or sections thereof, by alternating layers of a non-porous ceramic die coating and a die coating including a porous thermal barrier layer of ceramic material produced by co-deposition, using a thermal spraying procedure, of a powder of said ceramic material and a powder of an organic polymer material and, after the co-deposition, heating said co-deposited layer on the mold or die component to remove the polymer material, and provide said porous thermal barrier layer of ceramic material having a thickness of about 250 to 400 μm.

20. A die coating according to claim 1, wherein the heating is to a temperature of up to 450° C. to remove the polymer material.

21. A die coating according to claim 7, wherein the heating is to a temperature up to 450° C. to remove the polymer material.

22. A die coating for use on the surface of a metal mold or die component contacted by molten a metal, said die coating including a porous thermal barrier layer of ceramic material produced by co-deposition, of a powder of said ceramic material and a powder of an organic polymer material using thermal spraying procedure followed by heating said co-deposited layer to a temperature up to 450° C. to remove the polymer material, and provide said porous thermal barrier layer of ceramic material having a thickness of about 250 to 400 μm.

23. A process for providing a die coating on a surface of a metal mold or die component comprising the steps of:

co-depositing powders of an organic polymer material and powders of a ceramic material on the surface of the metal mold or die component by a thermal spraying procedure;

heating the metal mold or die component to a temperature up to 450° C. to remove the polymer material and leave a porous thermal barrier coating of the ceramic material having a thickness of about 250 to 400 μm.

24. A coated metal mold or die component including a porous thermal barrier layer of ceramic material formed by co-deposition of a powder of said ceramic material and a powder of an organic polymer material, and heating the co-deposited layer to a temperature of up to 450° C. to remove the polymer material, and provide said porous thermal barrier layer of ceramic material having a thickness of about 250 to 400 μm.

25. The coated metal mold or die component of claim 24, wherein the ceramic material is at least one material selected from the group consisting of oxides, nitrides, carbides and borides.

26. The coated metal mold or die component of claim 25, wherein the ceramic material is at least one material selected from the group consisting of alumina, titania, silica, stabilized zirconia, silicon nitride, boron nitride, silicon carbide, tungsten carbide, titanium borides and zirconium boride.

27. The coated metal mold or die component of claim 24, wherein the ceramic material is at least one mineral compound or heavy mineral sand selected from the group consisting of clay minerals, hard rock ore, ilmenite, rutile and zircon.

28. The coated metal mold or die component of claim 24, wherein the ceramic material is obtained from scoria or pumice.

29. A die coating for use on the surface of a metal mold or metal die component contacted by molten metal in low pressure or gravity die casting, said die coating including a porous layer of ceramic material produced by co-deposition, using a thermal spraying procedure, of a powder of said ceramic material having a particle size of 1-60 μm and a powder of an organic polymer material having a particle size of 5-45 μm and, after the co-deposition, heating said co-deposited layer on the mold or die component to remove the polymer material, and provide said porous layer of ceramic material.

30. A die coating according to claim 29, wherein said ceramic powder is at least one ceramic powder selected from the group consisting of oxides, nitrides, carbides and borides.

31. A die coating according to claim 29, wherein said ceramic powder is at least one mineral compound powder selected from the group consisting of clay minerals, hard rock ore and heavy mineral sands.

32. A process for providing a die coating on the surface of a metal mold or metal die component, comprising the steps of forming an initial coating of organic polymer material, the polymer material having a particle size of 5-45 μm and ceramic material on the surface by co-deposition of powders of the materials by a thermal spraying procedure, and heating the initial coating so as to remove the polymer material and leave a coating of ceramic material with voids therein, thus forming a porous coating of the ceramic material.

33. A process according to claim 32, wherein said polymer material is removed by combustion and/or decomposition.

34. A process according to claim 33, wherein a substantially uniform die coat is provided over all surfaces of the mold or die components, which define a die cavity.

35. A process according to claim 34, wherein said coating has a thickness of from about 250 to 400 μm.

36. A metal mold or metal die component having a surface for contact by molten metal in low pressure or gravity die casting, said surface being coated fully, or in a section or sections thereof, by a die coating according to claim 29.

37. A die coating according to claim 1, wherein the porous thermal conducive barrier layer forms the outer surface of the coating that contacts the molten metal in low pressure or gravity die casting.

38. A die coating according to claim 1, wherein the surface roughness $R_a$ of the porous thermal conducive barrier layer is at least 10 μm.

39. A process according to claim 8, wherein the porous thermal conducive barrier layer forms the outer surface of the coating that contacts the molten metal in low pressure or gravity die casting.

40. A process according to claim 8, wherein the surface roughness $R_a$ of the porous thermal conducive barrier layer is at least 10 μm.

41. A metal mold or die component according to claims 19, wherein the porous thermal conducive barrier layer forms the outer surface of the coating that contacts the molten metal in low pressure or gravity die casting.

42. A metal mold or die component according to claims 19, wherein the surface roughness $R_a$ of the porous thermal conducive barrier layer is at least 10 μm.

43. A coated metal mold or die component according to claim 24, wherein the porous thermal conducive barrier layer forms the outer surface of the coating that contacts the molten metal in low pressure or gravity die casting.

44. A coated metal mold or die component according to claim 24, wherein the surface roughness $R_a$ of the porous thermal conducive barrier layer is at least 10 μm.

45. A die coating according to claim 22, wherein the porous thermal conducive barrier layer forms the outer surface of the coating that contacts the molten metal in low pressure or gravity die casting.

46. A die coating according to claim 22, wherein the surface roughness $R_a$ of the porous thermal conducive barrier layer is at least 10 μm.

47. A process according to claim 23, wherein the porous thermal conducive barrier layer forms the outer surface of the coating that contacts the molten metal in low pressure or gravity die casting.

48. A process according to claim 23, wherein the surface roughness $R_a$ of the porous thermal conducive barrier layer is at least 10 μm.

49. A die coating according to claim 29, wherein the porous thermal conducive barrier layer forms the outer surface of the coating that contacts the molten metal in low pressure or gravity die casting.

50. A die coating according to claim 29, wherein the surface roughness $R_a$ of the porous thermal conducive barrier layer is at least 10 μm.

51. A process according to claim 32, wherein the porous thermal conducive barrier layer forms the outer surface of the coating that contacts the molten metal in low pressure or gravity die casting.

52. A process according to claim 32, wherein the surface roughness $R_a$ of the porous thermal conducive barrier layer is at least 10 μm.

* * * * *